United States Patent [19]

Dunkerly, II

[11] 4,285,647

[45] Aug. 25, 1981

[54] APPARATUS FOR THE MANUFACTURE OF FIBROUS WEBS

[75] Inventor: Cedric A. Dunkerly, II, Appleton, Wis.

[73] Assignee: American Can Company, Greenwich, Conn.

[21] Appl. No.: 89,927

[22] Filed: Oct. 31, 1979

[51] Int. Cl.[3] ..... B29H 1/02

[52] U.S. Cl. ..... 425/82.1; 425/83.1; 19/296

[58] Field of Search ..... 425/82.1, 83.1; 19/296

[56] References Cited

U.S. PATENT DOCUMENTS

| | | | |
|---|---|---|---|
| 3,748,693 | 7/1973 | Jespersen | 425/82.1 |
| 4,004,323 | 1/1977 | Gotchel et al. | 425/82.1 |
| 4,035,870 | 7/1977 | Reba et al. | 425/83.1 |
| 4,111,294 | 9/1978 | Carpenter et al. | 425/83.1 |
| 4,180,378 | 12/1979 | Mielke | 425/83.1 |

*Primary Examiner*—Donald E. Czaja
*Assistant Examiner*—James R. Hall
*Attorney, Agent, or Firm*—Robert P. Auber; George P. Ziehmer; Harry W. Hargis, III

[57] ABSTRACT

Apparatus and method for the manufacture of a fibrous web comprises a distributor for depositing dry wood fibers on a planar section of a linearly movable forming wire. A suction box is disposed to the side of the forming wire opposite the distributor. The distributor and suction box are so cooperatively constructed and arranged as to impart a velocity component to the fibers in the direction of movement of the forming wire, so that the angle of inclination of fiber deposition relative to the moving forming wire is from about 21 degrees to about 30 degrees.

11 Claims, 8 Drawing Figures

FIG. 5
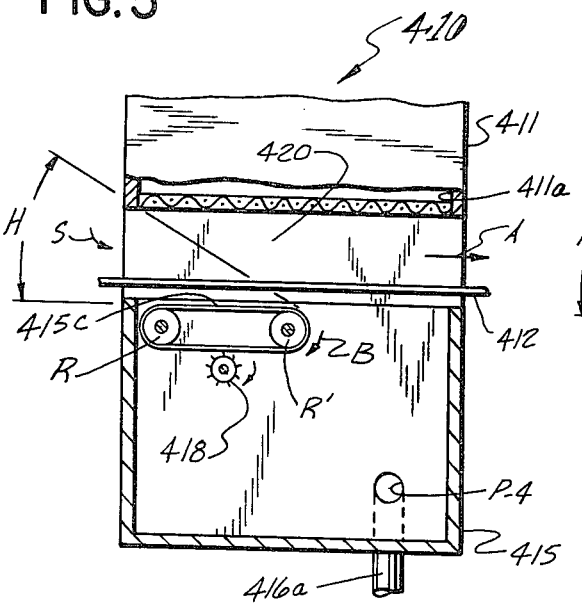
FIG. 6
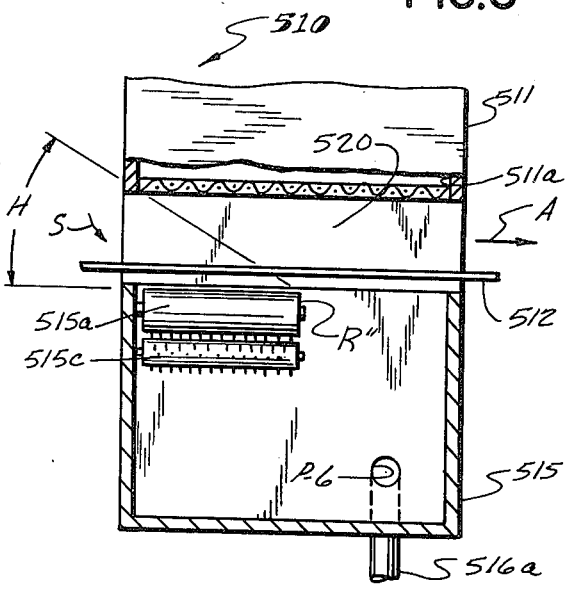
FIG. 7
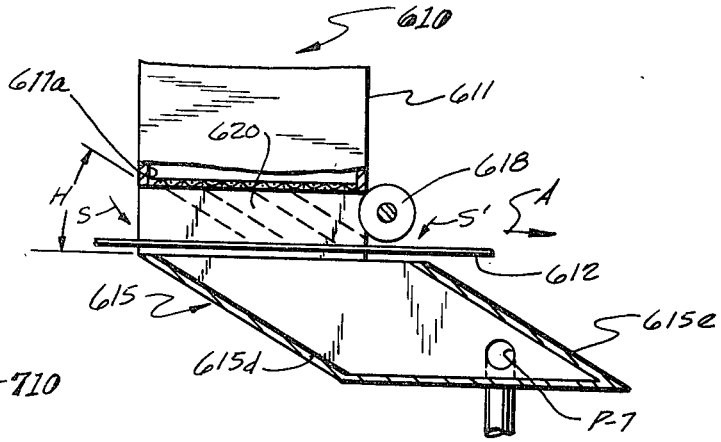
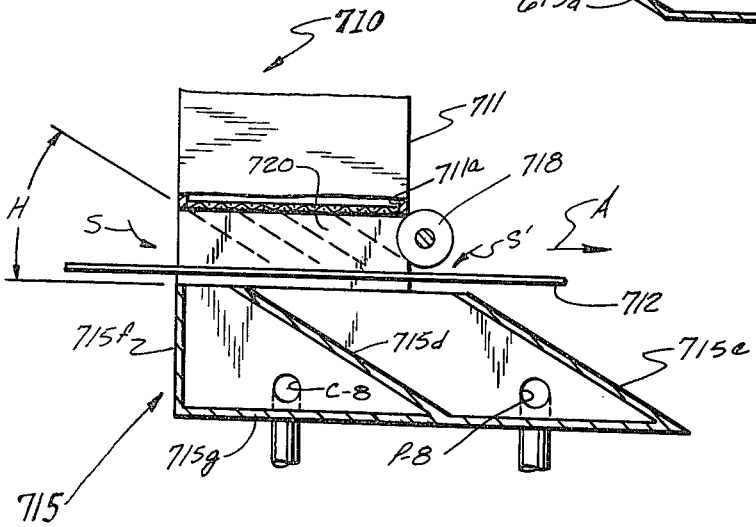
FIG. 8

APPARATUS FOR THE MANUFACTURE OF FIBROUS WEBS

BACKGROUND OF THE INVENTION

This invention relates to improvements in the manufacture of fibrous webs, such as paper and the like. More particularly, the invention is directed to improvements in the manufacture of tissue by the air-lay principle.

In the manufacture of fibrous webs such as paper by the air-lay principle, care must be taken to ensure uniformity of distribution of fibers on a forming wire. Air laid fibrous webs have a tendency to undesirable formation of ripples that extend transversely of the forming wire and weaken the web in the machine direction. These ripples form when attempts are made to operate at economical high forming wire velocities in excess of a range from about 500 feet per minute to about 550 feet per minute at economical air velocities in a range of from about 250 to about 300 feet per minute through the forming wire. The ripples do not tend to form at lesser velocities of the forming wire.

U.S. Pat. Nos. 4,004,323, 4,035,870, and 3,748,693 are representative of the prior art, and are believed material to the examination of this application.

U.S. Pat. No. 4,004,323 discloses, in FIG. 2, a formation duct 22A disposed at an angle of incidence B to a linear foraminous forming surface 24A, in a range of from about 10 degrees to about 30 degrees, most preferably about 20 degrees. The patent further discloses that: the front and rear inner surfaces 32A and 34A be divergent at an angle of about 1½ degrees, but preferably that they be parallel; and that the forming surface speed may be in excess of 200 feet per minute. No criticalities are assigned the velocity of air through the forming surface and the relative velocity of the fibers to the forming surface in the direction of movement of the latter.

U.S. Pat. No. 4,035,870 discloses fiber conduit 10 and forming bell 14 coaxially aligned along an axis disposed at an acute angle to the forming surface 16 of wire 17 so that fibers are deposited on surface 16 in a direction having a vector component coinciding with the direction of movement of surface 16.

U.S. Pat. No. 3,748,693 discloses vanes 54 in a suction box 34 having upstream and downstream air outlets 38. The vanes 54 extend transversely of movement of a forming wire 30 and are selectively adjustable to differentially restrict air flow through wire 30 to vary web thickness.

It is a general objective of this invention to provide an improved apparatus and method for the manufacture of air-laid fiber webs.

It is a further objective of the invention to provide improved apparatus and method for the manufacture of fiber webs wherein the webs are substantially devoid of ripples.

It is a still further objective of the invention to provide improved means for uniformly distributing fibrous material onto a forming wire of apparatus for the manufacture of fibrous webs.

SUMMARY OF THE INVENTION

In achievement of the foregoing as well as other objectives and advantages, the invention contemplates improvements in both an apparatus and method for the manufacture of fiber webs comprising, in its apparatus aspect, distributor means for dry fibers, a forming wire including a planar section disposed beneath said distributor means and linearly movable at a predetermined first velocity, suction box means disposed beneath said planar section of said forming wire and operative to draw air through said screen at a predetermined second velocity normal to said planar section, and means for imparting a horizontal velocity component less than said first velocity to said fibers in the direction of movement of said forming wire, wherein the fibers are caused to impinge upon the forming wire at an angle of from about 21 degrees to about 30 degrees, said second velocity is in excess of about 250 feet per minute and said first velocity is in excess of about 500 feet per minute.

The manner in which the foregoing as well as other objectives and advantages of the invention may best be achieved will be more fully understood from a consideration of the following description, taken in light of the accompanying drawing.

BRIEF DESCRIPTION OF THE DRAWING

FIGS. 2 to 8 are showings similar to FIG. 1, and illustrating modified embodiments of the apparatus.

DESCRIPTION OF THE SEVERAL EMBODIMENTS

Figure 1:
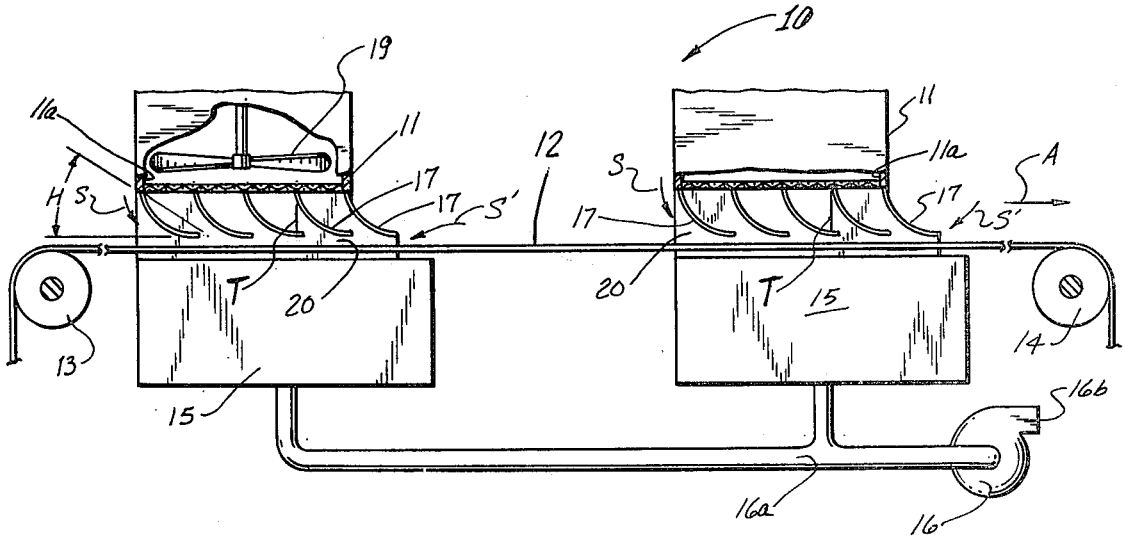
FIG. 1 is a diagrammatic elevational view showing, with parts fragmented and parts in section, of fibrous web forming apparatus embodying the invention and useful in carrying out the method aspects of the invention.

With more detailed reference to the drawing, there is seen in FIG. 1 an apparatus 10 for forming a web of fibrous material, comprising a set of dry fiber distributors 11 each including an impeller one of which is seen at 19, positioned above a horizontally extending planar section of a forming wire 12 that is supported for movements on suitably mounted rollers 13 and 14 rotatable to produce movement of the forming wire section, in the direction of arrow A at a predetermined velocity $V_1$. Suction boxes 15 are disposed beneath forming wire 12, each offset at its right-hand, trailing edge, in the downstream direction of movement of the wire (i.e., machine direction) as respects a corresponding distributor 11. A pair of parallel deckles or side plates are provided along sides of forming wire 12 at each distributor 11. Only one plate 20 of each pair is shown. A blower 16 has its inlet 16*a* connected to suction boxes 15 and its discharge 16*b* exits to atmosphere. Blower 16 is operative to create an air flow downwardly through the horizontal section of forming wire 12, normal thereto, at a velocity $V_2$, preferably in or in excess of about 250 feet per minute.

An array of vanes 17 extend across the bottom openings 11*a* of suction boxes 11 between plates 20. Vanes 17 of each array are parallel, are mutually equally spaced and extend transversely of the direction of movement A of forming wire 12. Each vane 17 is a 90° segment of a hollow right circular cylinder, and is so positioned that the tangent to the upper edge is substantially perpendicular to the plane of opening 11*a*, i.e. substantially parallel to the flow of air and fibers from the distributor, and the tangent to the lower edge is substantially parallel to the direction of movement of the forming wire, and spaced preferably about ¼ inch above the latter. The vanes are spaced one from the other so that the tangent T to the upper edge of one vane intersects the lower edge region of the next upstream vane.

In especial accordance with the invention, the described trailing-edge offset of suction boxes 15, in combination with the described shape and disposition of vanes 17, is such as to impart a horizontal velocity component $V_3$ to the air, and to the air-entrained fibers flowing between the bottom openings 11*a* of distributors 11 and the surface of forming wire 12, through spaces between vanes 17. Ambient air drawn in at S enhances the horizontal component $V_3$, and ambient air drawn in at S' aids in holding the web on the forming wire. This will be the case for the several embodiments where indicated. Horizontal velocity component $V_3$ is less than the velocity Vof the forming wire, which velocity $V_1$ is preferably in excess of about 500 feet per minute. The amount of offset is such as to create an air and dry-fiber flow from openings 11*a* to forming wire 2, downwardly and in the direction of forming-wire travel at an angle H in a range of from about 21 degrees to about 30 degrees measured from the horizontally extending forming wire. Such an acute angle of fiber impingement on wire 12 is based on the finding that successful web formation, free of ripples extending transversely of the forming wire (i.e., cross machine direction) is achieved if the ratio of the total magnitude of the tangential velocity relative to the forming wire 12 (i.e. $V_1$–$V_3$) to that of the through air velocity normal to the forming wire (i.e. $V_2$) induced by the suction box does not exceed about 2.5:1, wherein 2.5 is approximately the cotangent of an angle H equal to about 22 degrees. The web (not shown) is removed from the forming wire 12 by suitable transfer apparatus of known construction (not shown) prior to movement of the wire over pulley 14.

Figure 2:
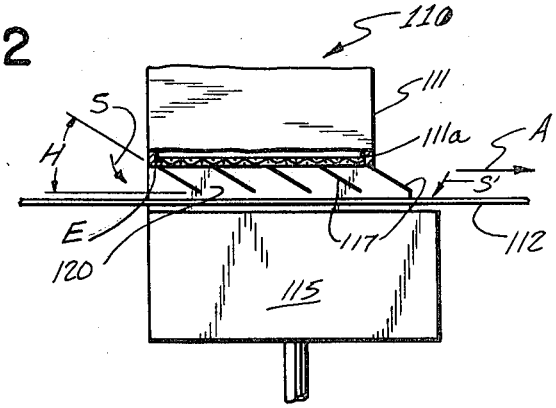

In the modified embodiment shown in FIG. 2, apparatus 110 includes distributors 111, only one of which is shown, beneath which there is a planar section of a forming wire 112 movable in the direction A at a predetermined velocity $V_1$. Suction box 115 is disposed directly below wire 112, in registry with distributor 111 at its upstream end, and offset at its right-hand, downstream end or trailing edge. The desired advantageous angular flow of fibers from opening 111*a* onto wire 112 is achieved by an array of parallel, mutually equally spaced flat vanes of baffle plates 117 extending over opening 111*a* in a direction transverse to the direction of wire travel A and at an acute angle H to the horizontally extending forming wire, which angle is in the range of from about 21 degrees to about 30 degrees. Vanes 117 preferably are disposed so that their upper ends are vertically aligned with a flat portion of an adjacent upstream vane. This disposition and angular relationship, in combination with the velocity $V_2$ of air normal to the forming wire 112, imparts the hereinabove described desired horizontal velocity component $V_3$ to the fibers.

Figure 3:
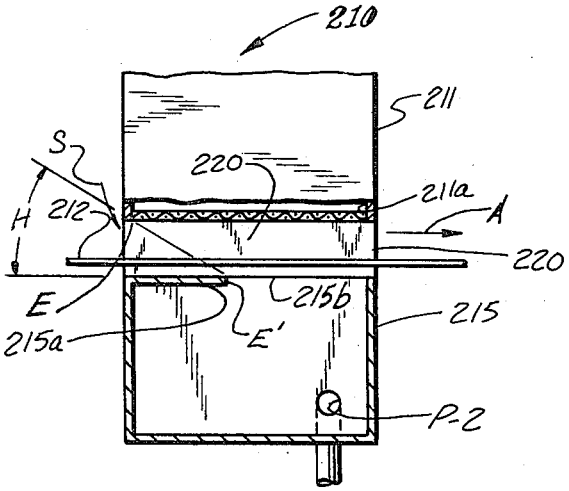

The modified embodiment 210 shown in FIG. 3 includes a distributor 211 having an outlet opening 211*a* disposed in registry with the suction box 215. Forming wire 212 is movable in the direction A as in the hereinabove described embodiments, and side plates 220 extend between the distributor and the forming wire. This embodiment is characterized by disposition of a baffle plate 215*a* extending horizontally from the left-hand, leading edge of suction box 215 and over a portion of the upper horizontal opening 215*b* beneath the forming wire. Baffle plate 215*a* is disposed to extend transversely of the direction of movement A of the wire 212, and is so dimensioned that a line intersecting the left edge E of opening 211*a* and the free edge E' of baffle plate 215*a* is at an acute angle H in order to achieve the desired angular air flow. Desired angle or air flow is further ensured by disposition of outlet port P-2 of the suction box 215 in a downstream region thereof.

Figure 4:
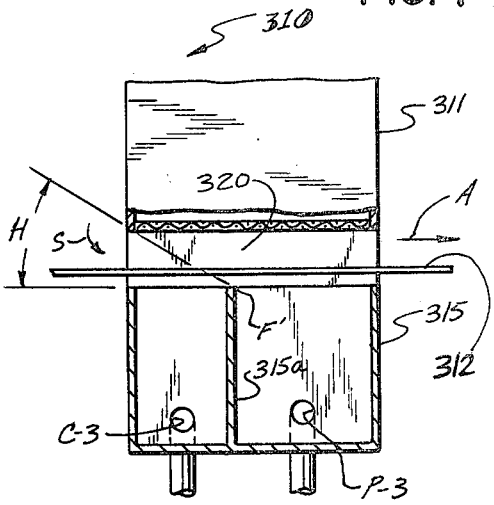

Still another modified embodiment 310 shown in FIG. 4 includes a distributor 311 and side plates 320, as described hereinabove, and a forming wire 312 movable thereunder in the direction A. A suction box 315 is disposed beneath the forming wire, in substantial registry with the distributor. A vertical partition 315*a* extends transversely of the suction box and forming wire 312, toward the upstream side of the suction box as respects forming-wire movement. The upper edge F of vertical baffle plate 315*a* is so positioned that a line extending therethrough and through the leading edge F' of opening 311*a* is at an acute angle H of about 30 degrees to the horizontal. Outlet port P-3 is disposed in the right-hand, downstream region of suction box 315, so that flow of air through the outlet port to the inlet of the suction pump (not shown) further ensures achievement of the hereinabove described desired angle H of air and fiber flow. A cleanout port C-3 is provided to facilitate removed of any fibers or dust falling into the dead-zone between baffle plate 315*a* and the upstream wall of suction box 315.

A still further modified embodiment 410 is seen in FIG. 5, and comprises a forming wire 412 movable in the direction A beneath the opening 411*a* of a distributor 411 provided with side plates 420. A suction box 415 is disposed beneath wire 412, in registry with distributor 411. The suction box 415 includes a belt 415*c* movable over sprocketed rollers R and R' in the direction of arrow B and disposed upstream of the direction of wire movement A while extending transversely of that direction of movement. Outlet port P-4 in the region downstream of belt 415*c* leads to inlet 416*a* of a suction pump in order to achieve, with the aid of the blanking action of belt 415*c*, flow at a predetermined desired acute angle H to the horizontal. A rotatable brush 418 engages the lower run of belt 415*c* continuously to dislodge any dust or fibers passing through forming wire 42 and landing on the belt.

The embodiment 510 shown in FIG. 6 is similar to that shown in FIG. 5, in provision of side plates 520, and a forming wire 512 movable in the direction indicated by arrow A beneath opening 511*a* of a fiber distributor 511. A suction box 515 is disposed beneath the forming wire, in registry with distributor 511. The suction box 515 includes outlet port P-6 disposed to the downstream side of suction box 515 and leading to inlet 516*a* of a suction pump in order to achieve flow through forming wire 512, at a predetermined desired acute angle H to the horizontal. A belt 515*a* is movable over sprocketed rollers R" transversely of the forming wire, and enhances deflection of fiber and air flow between the distributor 511 and the forming wire 512, and, with the aid of rotatable brush 515*c*, is operative to clean its lower run, advantageously disposing of accumulation of dust and fibers thereon that normally are sifted through the forming wire.

The embodiment 610 seen in FIG. 7 includes a distributor 611 with side plates and having its bottom opening 611*a* disposed above a forming wire 612 movable in the direction of arrow A. A suction box 615 is disposed beneath the forming wire so that its upper opening is slightly larger than the opening 611*a*, and has its upstream or leading edge aligned with opening 611*a* and its downstream or trailing edge disposed slightly downstream of opening 611*a*. A sealing roll 618 is positioned for rotation on an axis extending transversely of the forming wire, so that its upper left quadrant is close to the edge of opening 611*a* and its lowermost surface is in substantial line contact with a web on wire 612. Further to the construction of the suction box 615, there is a space between the trailing edge of its opening and roll 618. The box 615 is of generally parallelogram shape in cross section, so that its upstream and downstream walls 615*d* and 615*e*, respectively, slope downwardly at an angle of about 30 degrees to the horizontal. Outlet port P-7 is disposed in a downstream corner of the suction box, the construction and arrangement being such that air and fibers will be drawn for impingement onto forming wire 612 at an acute angle H preferably of about 30 degrees.

The embodiment shown in FIG. 8 comprises apparatus 710 similar to that seen in FIG. 7, including the construction of distributor 711 and its opening 711*a*, forming wire 712 and its direction of travel A, side walls 720, and the disposition of sealing roll 718. Suction box 715 again is substantially of generally parallelogram cross section, having the upper edges of its trailing, downwardly sloping wall disposed slightly downstream of sealing roll 718, and the upper edge of its upstream, downwardly sloping wall spaced slightly downstream from the leading edge of opening 711*a*. Suction box 715 includes an upstream extension defined by a vertical wall 715*f* in combination with wall 715*d* and the bottom wall extension 715*g* of the suction box. A cleanout port C-8 communicates with the suction box extension, which is in fact a dead space, and is selectively operative to remove dust and the like from this space. Outlet port P-8 is disposed in a downstream corner of suction box 715, and is cooperative with the other described structure to induce impingement of fibers at an acute angle H of from about 21 degrees to about 30 degrees onto forming wire 712.

While no sealing mechanisms are shown on the downstream sides of the forming heads shown in FIGS. 3, 4, 5, and 6, one skilled in the art will appreciate that sealing mechanisms may be desired, such as those shown in FIGS. 1, 2, 7, and 8. Choice of the specific design is determined in each case to best cooperate with the remainder of the system.

While several embodiments of the invention have been disclosed, it will be understood that the invention is susceptible of such other modifications as may fall within the scope of the appended claims.

I claim:

1. An apparatus for the manufacture of fiber webs, comprising: distributor means for dry fibers; a forming wire including a planar section disposed beneath said distributor means and linearly movable at a predetermined first velocity; suction box means disposed beneath said planar section of said forming wire and operative to draw air through said forming wire at a predetermined second velocity normal to said planar section; and means for imparting a horizontal velocity component less than said first velocity to said fibers in the direction of movement of said forming wire, wherein the fibers are caused to impinge uopn the forming wire at an angle of from about 21 degrees to about 30 degrees, said second velocity is in excess of about 250 feet per minute, and said first velocity is in excess of about 500 feet per minute.

2. Apparatus of claim 1, wherein said means for imparting a horizontal velocity component comprises an array of parallel, mutually equally spaced vanes extending transversely of said planar sections of said forming wire, said vanes being disposed between said distributor and said planar section and comprising substantially a 90° segment of a hollow circular cylinder so positioned that the tangent to its upper edge is substantially parallel to the flow of air and fibers from said distributor means and the tangent to the lower edge is substantially parallel to and spaced from the planar section of said forming wire and web, said vanes further being cooperative with said suction box to direct the flow of fibers from said distributor at an acute angle to said planar section of said forming wire, in the direction of its movement.

3. Apparatus of claim 1, wherein said means for imparting a horizontal velocity component comprises an array of parallel, mutually equally spaced baffle plates extending over a bottom, horizontally extending opening provided in the distributor means, in a direction transverse to the direction of forming wire movement, spaced from a web thereon, and inclined downwardly in the direction of said movement at an angle in the range from about 21 degrees to about 30 degrees to the forming wire.

4. Apparatus of claim 1, wherein said means for imparting a horizontal velocity component comprises baffle means extending horizontally over the upstream region of an upper, horizontally extending opening provided in said suction box means beneath said forming wire, in a direction transverse to the movement of the latter, and including a free edge portion presented in the direction of movement of said forming wire, wherein an imaginary line extending between the upstream edge of said distributor and said free edge portion of said baffle plate extends downwardly at an angle in the range of from about 21 degrees to about 30 degrees to the forming wire.

5. Apparatus of claim 1, wherein said suction box comprises: an internal baffle plate spaced from the upstream wall of said suction box in the direction of forming wire movement; an outlet port for the downstream region of said suction box defined in part by the baffle plate, said outlet port leading to provided suction-producing means whereby the upstream region of said suction box, as respects the direction of movement of said forming wire, is blocked and the recited predetermined angle of air flow is produced.

6. Apparatus of claim 4, wherein said baffle means comprises an endless belt having an upwardly presented surface and mounted to move said surface beneath said forming wire; and including a rotatable brush disposed to engage a lower disposed run of said belt.

7. Apparatus of claim 6, wherein said endless belt is mounted to move said surface in a direction transverse the direction of movement of said forming wire.

8. Apparatus of claim 6, wherein said endless belt is mounted to move said surface in the direction of movement of said forming wire.

9. Apparatus of claim 5, wherein means defining a cleanout port is disposed in air flow communication with the upstream region defined by said baffle plate.

10. An apparatus for the manufacture of fibrous webs, comprising: distributor means for dry fibers having a bottom, horizontally extending opening; a planar section disposed beneath said opening, and linearly movable at a predetermined first velocity; suction box means disposed beneath said planar section of said forming wire, and operative to draw air through said forming wire at a predetermined second velocity normal to said forming wire, said suction box being defined in part by parallel upstream and downstream walls that extend transversely of the direction of movement of said forming wire and are inclined downwardly in said direction of movement at an angle in a range of from about 21 degrees to about 30 degrees from the horizontal, the upper edge of the upstream wall being aligned with the upstream edge of the distributor bottom opening and the upper edge of the downstream wall being spaced slightly downstream of said distributor bottom opening in provision of a gap extending transversely of the direction of forming wire movement; an outlet port disposed in the lower region of said suction box adjacent the lower edge of said downstream wall; and a sealing roll extending transversely of said forming wire movement and partially covering said gap, the construction and arrangement being such that a horizontal velocity component less that said first velocity is imparted to said air and fibers in the direction of movement of said forming wire.

11. An apparatus for the manufacture of fibrous webs, comprising: distributor means for dry fibers having a bottom, horizontally extending opening; a planar section disposed beneath said opening, and linearly movable at a predetermined first velocity; suction box means disposed beneath said planar section of said forming wire and operative to draw air through said forming wire at a predetermined second velocity normal to said forming wire, said suction box being defined in port by parallel upstream and downstream walls that extend transversely of the direction of movement of said forming wire and are inclined downwardly in said direction of movement and disposed at an angle in a range of from about 21 degrees to about 30 degrees from the horizontal, the upper edge of the upstream wall being spaced slightly downstream of the upstream edge of the distributor bottom opening and the upper edge of the downstream wall being spaced slightly downstream of said distributor bottom opening in provision of a gap extending transversely of the direction of forming wire movement; an outlet port disposed in the lower region of said suction box adjacent the lower edge of said downstream wall; a vertical wall spaced upstream of said upstream inclined wall aligned with the upstream edge of said bottom opening, and cooperatively disposed with said inclined wall to form a dead space beneath said forming wire; a clean out port communicating with said dead space; and a sealing roll extending transversely of said forming wire movement and partially covering said gap, the construction and arrangement being such that a horizontal velocity component less than said first velocity is imparted to said air and fibers in the direction of movement of said forming wire.

* * * * *